US006080011A

United States Patent [19]

Tsao et al.

[11] Patent Number: 6,080,011

[45] **Date of Patent: *Jun. 27, 2000**

[54] STACKED DOUBLE DECK MODULAR GANG JACK CONNECTOR

[75] Inventors: Jenn Tsao, Taoyuan, Taiwan; Yakov Belopolsky, Harrisburg, Pa.

[73] Assignee: Berg Technology, Inc., Reno, Nev.

[ * ] Notice: This patent is subject to a terminal disclaimer.

[21] Appl. No.: 09/163,612

[22] Filed: Sep. 30, 1998

Related U.S. Application Data

[63] Continuation-in-part of application No. 09/043,045, filed as application No. PCT/US96/14589, May 12, 1998

[60] Provisional application No. 60/076,894, Mar. 5, 1998.

[51] Int. Cl.[7] ..... H01R 13/60

[52] U.S. Cl. ..... 439/541.5; 439/541.5; 439/676; 439/540.1

[58] Field of Search ..... 439/541.5, 676, 439/79, 540.1

[56] References Cited

U.S. PATENT DOCUMENTS

| | | | |
|---|---|---|---|
| 4,103,985 | 8/1978 | Krolak et al. . | |
| 4,220,391 | 9/1980 | Krolak et al. . | |
| 4,303,296 | 12/1981 | Spaulding . | |
| 4,425,018 | 1/1984 | Stenxz . | |
| 4,655,521 | 4/1987 | Thomas . | |
| 4,944,698 | 7/1990 | Siemon et al. | 439/676 |
| 5,129,842 | 7/1992 | Morgan et al. | 439/532 |
| 5,178,554 | 1/1993 | Siemon et al. | 439/188 |
| 5,308,260 | 5/1994 | Johnston et al. | 439/344 |
| 5,328,390 | 7/1994 | Johnston et al. | 439/638 |
| 5,425,172 | 6/1995 | Carswell et al. | 29/884 |
| 5,431,586 | 7/1995 | Klas et al. | 439/676 |
| 5,480,326 | 1/1996 | Chen et al. | 439/607 |
| 5,531,612 | 7/1996 | Goodall et al. | 439/541.5 |
| 5,556,301 | 9/1996 | Chishima et al. | 439/507 |
| 5,562,493 | 10/1996 | Ferrill et al. | 439/536 |
| 5,562,507 | 10/1996 | Kan | 439/676 |
| 5,599,206 | 2/1997 | Slack et al. | 439/536 |
| 5,639,267 | 6/1997 | Loudermilk | 439/701 |

*Primary Examiner*—Gary F. Paumen
*Assistant Examiner*—Truc Nguyen
*Attorney, Agent, or Firm*—Daniel J. Long; Brian J. Hamilla; M. Richard Page

[57] ABSTRACT

A modular jack assembly including an insulative housing which has a first element a first and a second longitudinal wall positioned in spaced parallel relation and a first pair of traverse walls interposed between said first and second longitudinal walls to form a first plug receiving port. There is also a second element which has a third and fourth longitudinal wall and a second pair of transverse walls are interposed between said third and further longitudinal walls to form a forward second plug receiving port. A releasable latch fixes the third longitudinal means of the second element in superimposed abutting relation on the second longitudinal wall of the first element. A first insulative insert having base and upper sides and rear end terminal ends and is positioned such that its terminal end extends into the first plug receiving port. A second insulative insert having base and upper sides and rear and terminal ends and is positioned so that its terminal end extends into the second plug receiving.

13 Claims, 9 Drawing Sheets

STACKED DOUBLE DECK MODULAR GANG JACK CONNECTOR

CROSS REFERENCE TO RELATED APPLICATION

This is a continuation-in-part of copending U.S. application Ser. No. 09/043,045, filed May 12, 1998, which claims rights under International Application No. PCT/US 96/14589, filed Sep. 12, 1996.

This application claims rights under U.S. application Ser. No. 60/076,894 entitled "Stacked Double Deck Modular Jack Connector" filed on Mar. 5, 1998 (8057 P).

This application is also related to U.S. application Ser. No. 60/076,844 entitled "Double Deck Gang Jack Exhibiting Suppressed Mutual Crosstalk" filed on Mar. 5, 1998 (4521 P) and to U.S. application Ser. No. 09/143,810 filed Aug. 31, 1998 (4521) having the same title.

BACKGROUND OF THE INVENTION

1. Field of the Invention:

The present invention relates to electrical connectors and more particularly to modular gang jack connectors.

2. Brief Description of Prior Developments:

Double deck multi-port modular jacks have been widely used by networking product manufacturers for specific needs where operative space is restricted. However, the overall requirement of double deck gang jack in the market place is small compared with single deck gang jack, for the double deck product is more costly than single deck product in addition to users actual needs in product application. It is because conventional double deck gang jacks in the market place use a one piece double deck housing, in which large amount of plastic material has restricted its productivity in molding process and flexibility to expand to any customized product length in a production mold. There is a need, therefore, for a way to stock existing single deck gang jack to a double deck configuration, so that it becomes possible and easier to fulfill various needs with customized product length in an economical manner.

SUMMARY OF THE INVENTION

The modular jack assembly includes an insulative housing. This housing includes a first element a first and a second longitudinal wall positioned in spaced parallel relation and a first pair of traverse walls interposed between said first and second longitudinal walls to form a first plug receiving port. There is also a second element comprising a third and fourth longitudinal wall and a second pair of transverse walls are interposed between said third and further longitudinal walls to form a forward second plug receiving port. A releasable latch means fixes the third longitudinal means of the second element in superimposed abutting relation on the second longitudinal wall of the first element. A first insulative insert having base and upper sides and rear end terminal ends and is positioned such that its terminal end extends into the first plug receiving port. A second insulative insert having base and upper sides and rear and terminal ends and is positioned so that its terminal end extends into the second plug receiving.

BRIEF DESCRIPTION OF THE DRAWINGS

As an invention is further described with reference to the accompanying drawings in which.

DETAILED DESCRIPTION OF THE PREFERRED EMBODIMENTS

An existing single deck gang jack is used as bottom deck and top deck respectively with limited modification on current product design and production tool, which intends to provide interlocking device for each part in this conceptual design. A rear cover in attached to latch both single deck gang jacks together in rear part and works as a guide block to correctly position of solder tails of top deck. With this conceptual design, the existing single deck gang jack, which commonly varies from a1-port to 12-port configuration can be easily expanded to a double deck gang jack in any customized product length without need for a tooling dedicated mold for the double deck product.

The rear cover is specifically designed to fit with existing features of single deck gang jack and is expandable to any customized product length. A V-shaped slot functionally works as solder tail guide to ensure better wire true position, and an additional tail guide block which has reversed V-shape slot is considered as an optional parts to be installed into rear cover to secure the solder tail true position for contingent need. All the latching tabs, however, are molded in the same plastic body of rear cover. Meanwhile, a metal clip is considered as an alternative design for the plastic latch in order to provide stiffer latching once it comes to a need, e.g. a longer product might need an additional latch in the central part where product space is restricted for the plastic latch. A conventional latching barb may be employed for the metal clip. However, there is plastic embossment in the engaging area to get the latching barb stretched, when metal clip is inserted into rear cover, so that the retention between both parts can be further improved.

Figure 4:
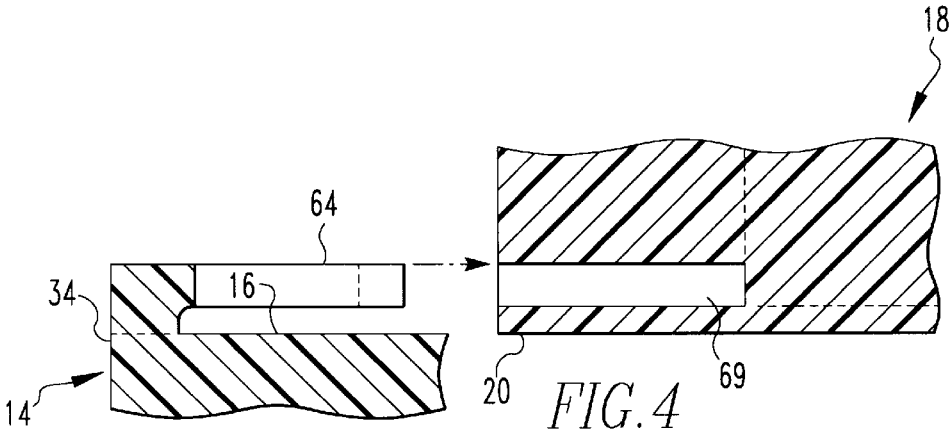
FIG. 4 is a cross sectional view through 4—4 and 4'—4' in FIG. 1 showing the engagement of the rear latch of the bottom element of the jack of the present invention with the top element of the jack of the present invention.
Figure 10:
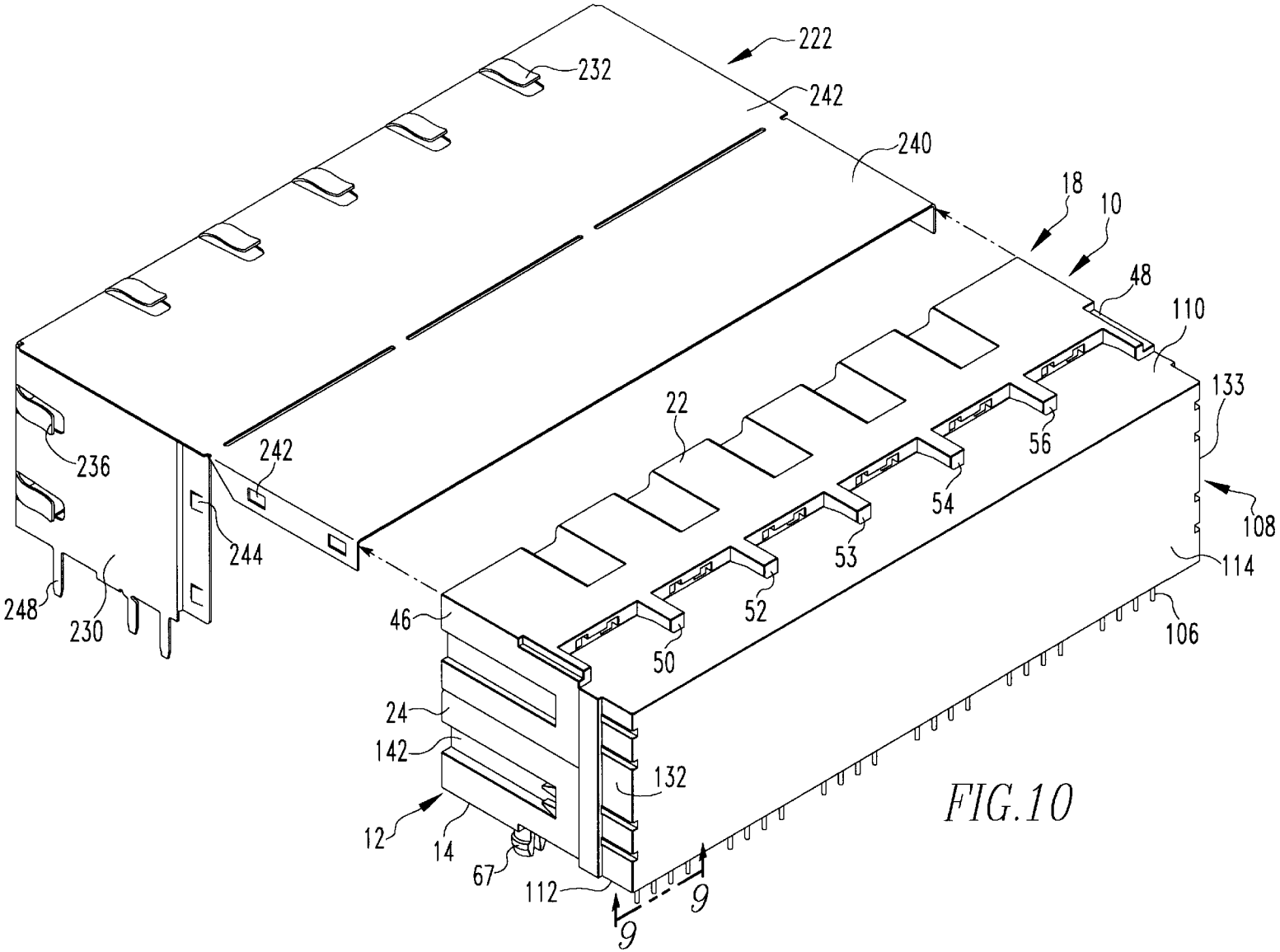
FIG. 10 is a front top perspective view of the assembled modular jack shown in FIG. 1 with a metallic shield.
Figure 12:
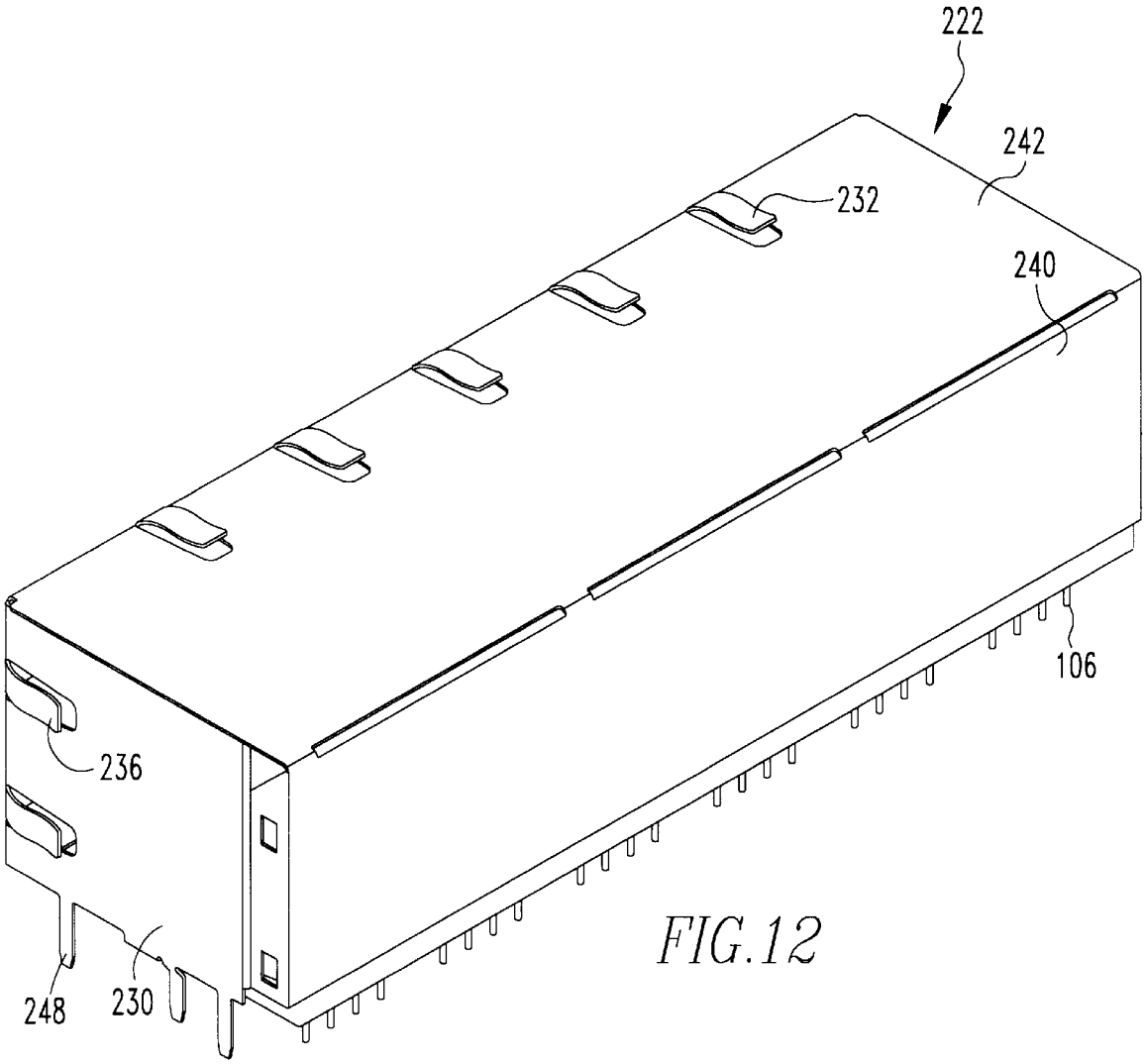
FIG. 12 is a perspective view of the modular gang jack similar to FIG. 10 in which the shield is positioned on the jack.
Figure 13:
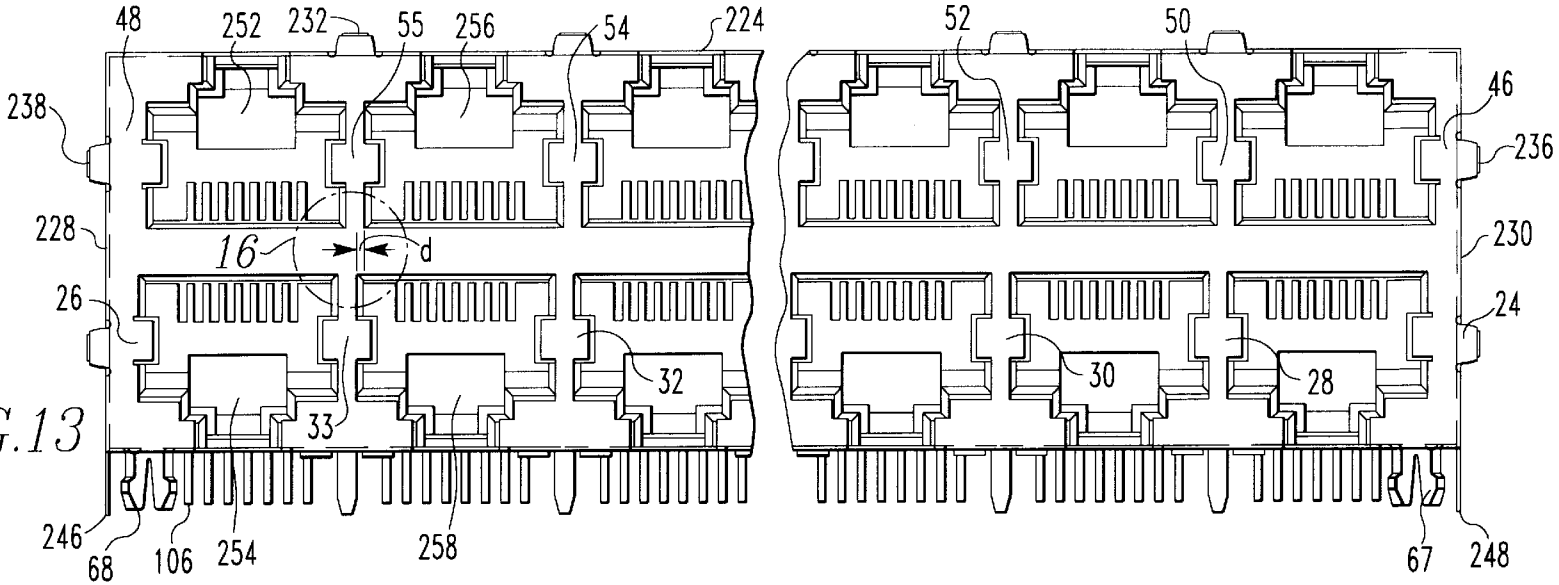
FIG. 13 is a fragmented front elevational view of the shielded modular gang shown in FIG. 12.
Figure 14:
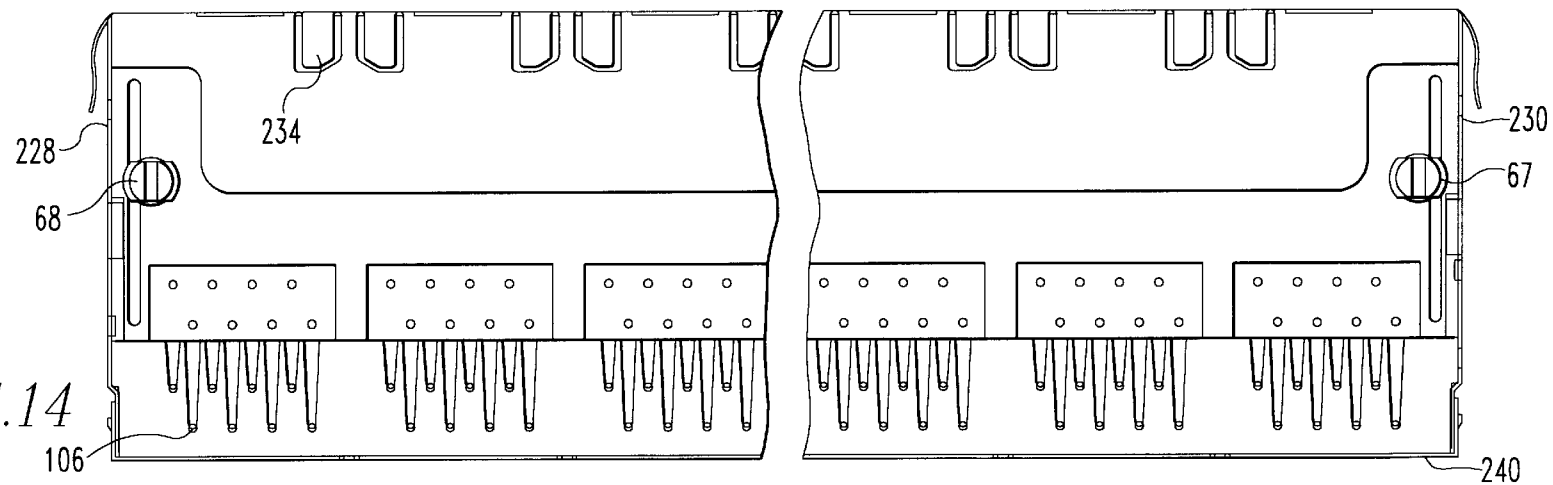
FIG. 14 is a bottom plan view of the shielded modular gang shown in FIG. 12.

Referring to FIGS. 1–12, the modular gang jack of this invention includes an insulative housing shown generally at numeral 10. This housing includes a lower element shown generally at 12 which includes a lower longitudinal wall 14 and an upper longitudinal wall 16. The housing also includes an upper element shown generally at 18 which includes a lower longitudinal wall 20 and an upper longitudinal wall 22. Interposed between the lower longitudinal wall 14 and the upper longitudinal wall 16 there are end vertical transverse walls 24 and 26 and medial vertical transverse walls 28, 30, 31, 32 and 35. Each of the elements has a front side 34 and a rear side 36. Between the vertical transverse walls plug receiving slots 38, 40, 42, 43, 44 and 45 are formed in the first element. As is conventional, a plug is inserted in the front side and an insert as is described hereafter as inserted in the rear side of these ports. Similarily, in the upper element 18, there are end vertical transverse walls 46 and 48 and medial vertical transverse walls 50, 52, 53, 54 and 55. These transverse walls form plug receiving ports 56, 58, 60, 61, 62 and 63. On the upper longitudinal walls 16 of the lower element 12 there is a first horizontally oriented latch 64, a second horizontally oriented latch 65 and a third horizontally oriented latch 66. On the lower longitudinal wall 14 of the lower element 12 there are conventional mounting pins 67 and 68 for engaging mounting apertures on a printed wiring board (PWB) or the like (not shown). Referring particularly to FIG. 4, it will be seen that these latches engage horizontal slots as at slot 69 in the lower longitudinal wall 20 of the upper element 18. Referring particularly to FIG. 10, each plug receiving port has a forward open end 70, a rearward open end 72, a medial wall 74 which has an inclined upper end 76 and a transverse extension 78. The medial wall also has a first step 80 and a second step 82. Referring again to the drawings in general there are a plurality of lower inserts as at insert 84. This insert includes a base side 86, an upper side 88, a rear end 90 and a forward end 92. A plurality of wires as at wires 93 and 94 extend upwardly from the base side to the upper side and then forward to the terminal end 92 and then diagonally and rearwardly toward the base side. There are also plurality of upper inserts as at 96. This insert includes a base side 98, an upper side 100, a medial vertical surface 101, a rear end 102 and a forward terminal end 104. A plurality of wires as at wires 105 and 106 extend upwardly from the base side to the upper side and then in a forward direction to the terminal end 104 from where they extend upwardly and rearwardly.

The modular gang jack also includes a rear cover shown generally at numeral 108. This rear cover has a top wall 110, a bottom wall 112 and a medial wall 114. The top wall has end recesses 116 and 118 and medial wall receiving recesses 120, 122, 123, 124 and 125. The medial wall has a plurality of deep V-shaped wire guide grooves as at slot 126 and a plurality of shallow V-shaped wire guide groove as at 127. The bottom wall 122 also has similar deep V-shaped wire guide slots as at slot 128 and shallow V-shaped wire guide slots as at slot 129. Each of the slots receives wires from an insert as at wires 130 and 131. The rear cover 108 also includes opposed side walls 132 and 133 and a back wall 134. Projecting in a forward direction from the side wall 132 there is a vertically oriented and forward extending lower latches 136. This latch engages slot 138 which is located respectively on the end transverse walls of the upper and lower elements respectively. Side 133 also has a similar vertically oriented lower latches (not shown) which engages slot 140 in the wall 24 on the lower element 12. The slot 140 is connected to a groove 142 in the wall 24 on the lower element 12.

Figure 5:
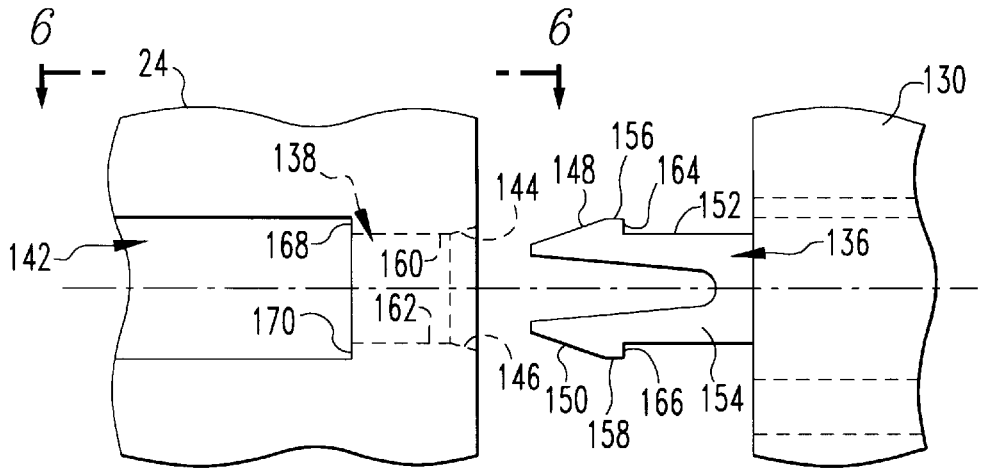
FIG. 5 is a detailed side elevational view of the areas in circles 5 and 5' in FIGS. 1 showing the engagement of the side latch on the rear cover and a receiving slot on the lower element of the jack of the present invention.
Figure 11:
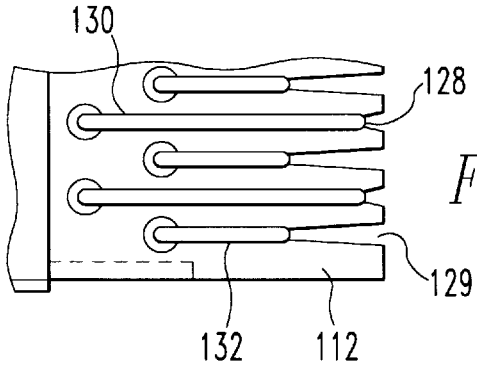
FIG. 11 is a partial bottom plan view of the modular jack of the present invention from 11—11 in FIG. 10.
Figure 6:
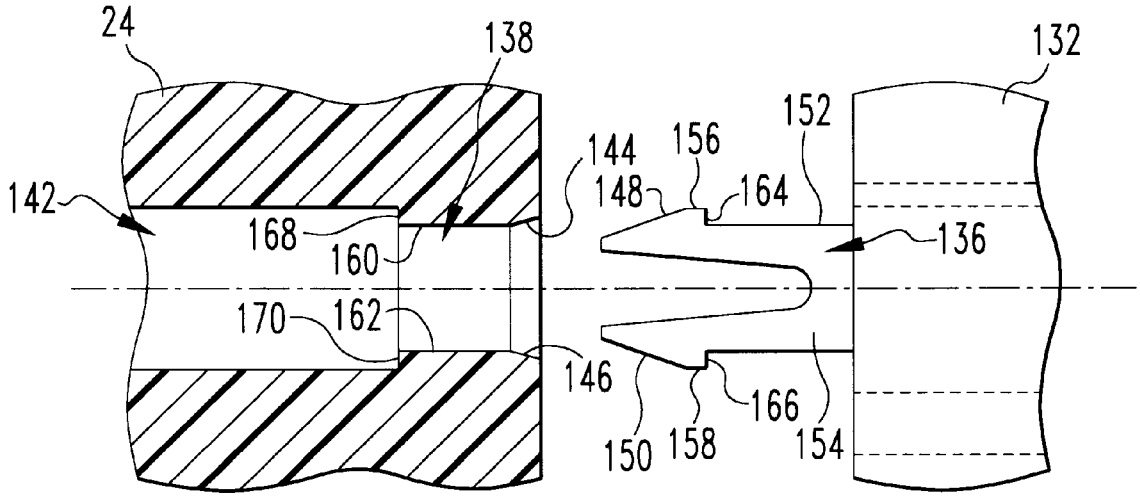
FIG. 6 is a view similar to FIG. 5 wherein the lower element of the jack of the present invention is in vertical cross section at 6—6 in FIG. 5.

Referring particularly to FIGS. 5–6, the slots as at slot 138 have a vertical inclined surfaces 144 and 146 for engagement of the inclined surfaces 148 and 150 respectively of legs 152 and 156 of the latches as at latch 136.

The legs 152 and 154 are compressed so that surfaces 156 and 158 on the legs bear against surfaces 160 and 162 on the slot 138 during insertion of the latch 136 therein. After insertion the front end of the latch 136 protrudes into grooves 142 and surfaces 164 and 166 of the latch bears against surfaces 168 and 170 at the rear end of slot 138. The latch 136 shown in FIGS. 5 and 6 are plastic and are integral with the cover 108.

Figure 7:
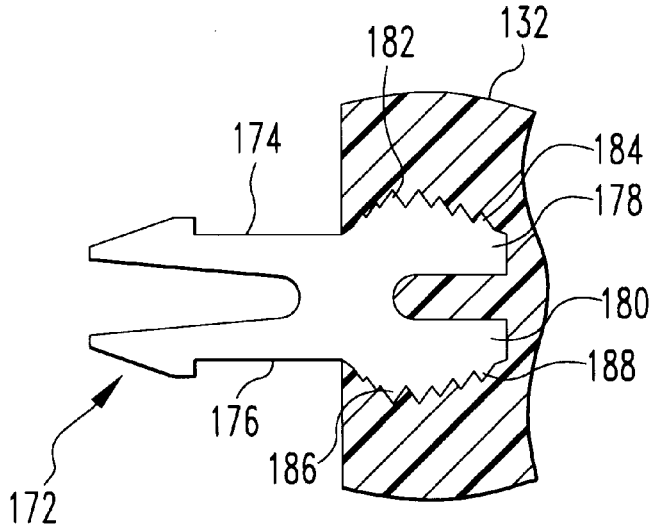
FIG. 7 is a view of an alternate embodiment of the side latch shown in FIGS. 5 and 6 with the front cover being shown in vertical cross section.
Figure 9:
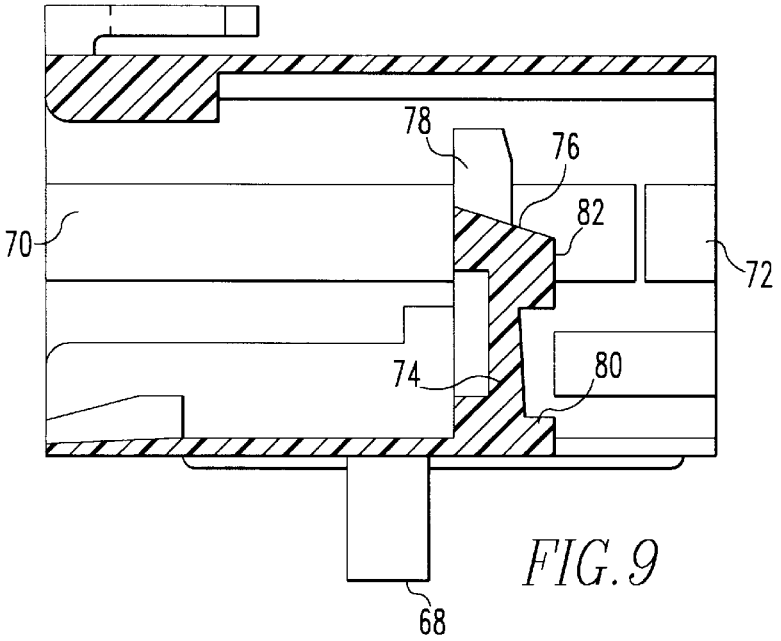
FIG. 9 is a cross sectional view through 9—9 in FIG. 1.
Figure 15:
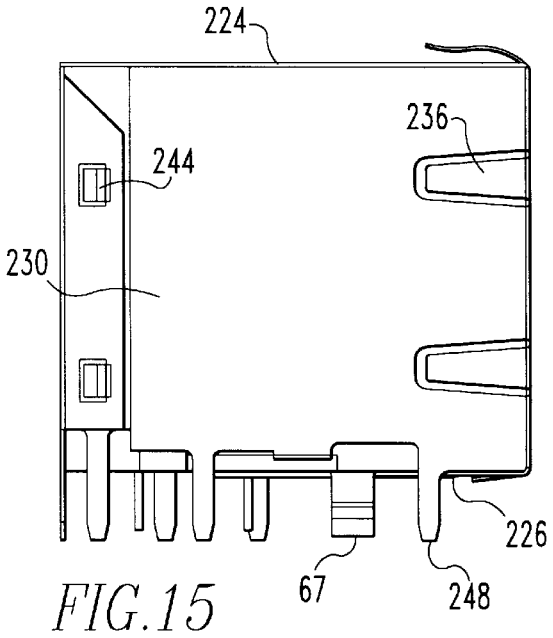
FIG. 15 is an end view of the modular gang jack shown in FIG. 12.
Figure 16:
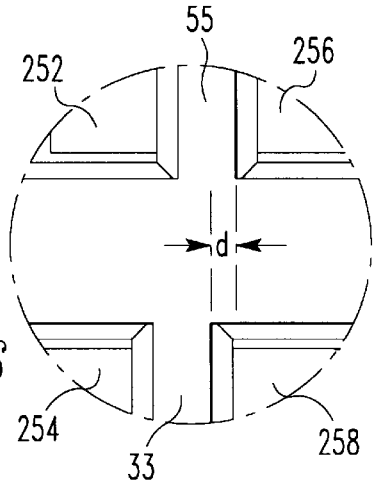
FIG. 16 is a detailed view of circle 16 in FIG. 13.

Referring to FIGS. 5–7, it is alternatively possible to use a metal latch 172 which has legs 174 and 176 which are structurally similar to legs 152 and 154 of latch 136 described above. Legs 174 and 176 of latch 172 engage the slot 138 and groove 142 in the side wall 24 in generally the same way as is described above for legs 152 and 154 of latch 136. In opposed relation to legs 174 and 176 there are respectively base legs 178 and 180 which are embedded in the plastic in wall 132 by means of a plurality of barbs as at barbs 182 and 184 in base leg 178 and barbs 186 and 188 in leg 180.

Figure 1:
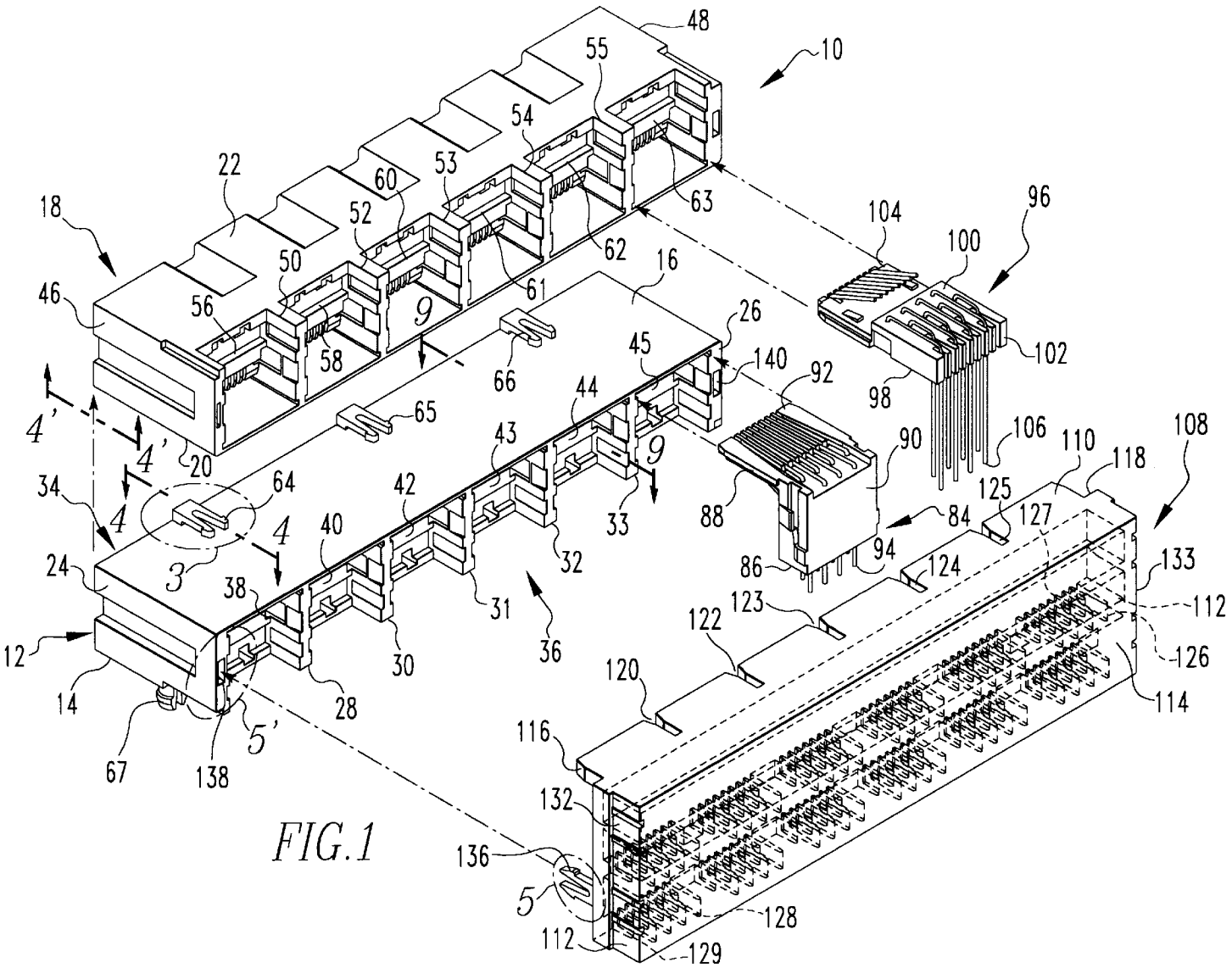
FIG. 1 is an exploded perspective view of a preferred embodiment of the modular gang jack of the present invention.
Figure 2:
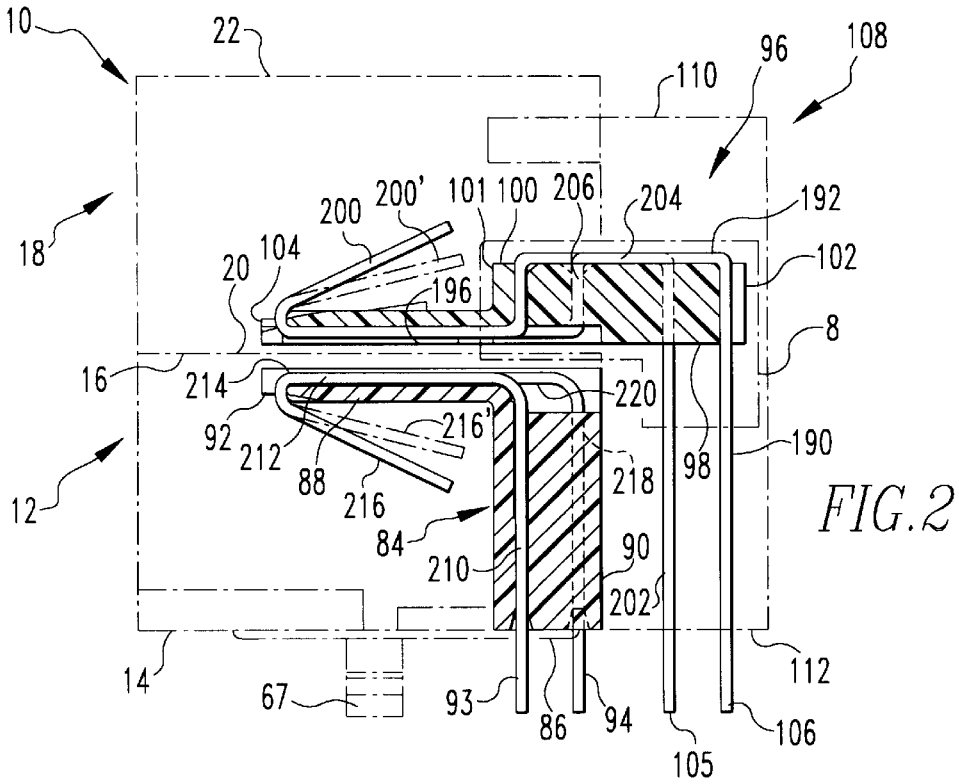
FIG. 2 is a vertical cross sectional view through one of the ports in the assembled modular jack connector shown in FIG. 1 with the inserts being shown in solid lines and the jack itself being shown schematically in phantom lines.
Figure 3:
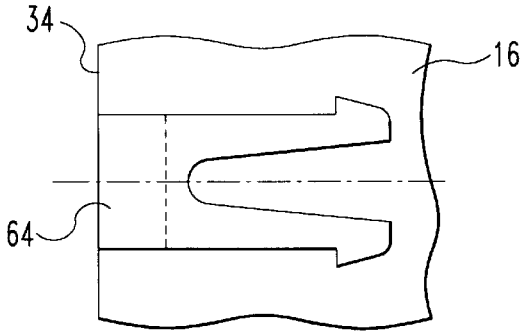
FIG. 3 is a top plan view of the latch shown in circle 3 in FIG. 1.
Figure 8:
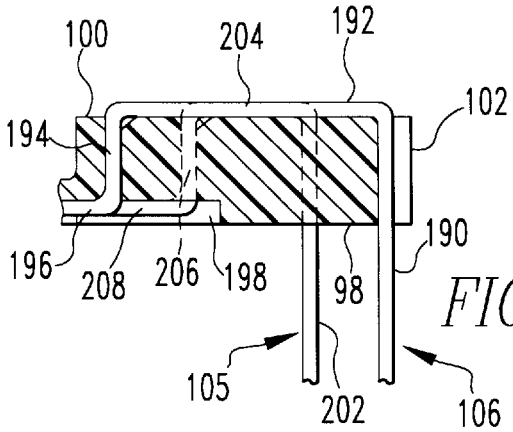
FIG. 8 is a detailed view of area 8 in FIG. 2.

Referring to FIGS. 2 and 8, the outer wires as at wire 106 in the upper inserts as at insert 96 have an upward vertical section 190 which extends upwardly through the insert to the top surface of the insert where the wire extends in a forward direction in a horizontal section 192. There is a downward vertical section 194 which extends through the insert 96 adjacent its medial vertical surface 101. At the base of the downward vertical section 194 the wire extends in a horizontal section 196 in a horizontal groove 198 in the insert 96. The wire 106 terminates in an upward and rearward oblique section 200 which when flexed is in position 200'. In wire 105 there is an upward vertical section 202 which passes through the insert 96 and at the top of the insert there is a horizontal section 204. A downward vertical section passes downwardly through the insert and in a groove in the base of the insert there is a horizontal section 208 after which there is an upward and rearward oblique section (not shown). The inner wire 93 on the insert 84 has a upward vertical section 210, a horizontal section 212 which is positioned in a horizontal groove 214 and a downward and rearward oblique section 216. The outer wire 94 in insert 84 has an upward vertical section 218, a horizontal section 220 and a downward and rearward oblique section (not shown) position behind the downward and rearward oblique section 216 of wire 93.

Referring to FIGS. 11–16, the modular jack may include a metallic shield shown generally at numeral 222. This metallic shield includes a top wall 224, a bottom flange 226, opposed side walls 228 and 230 which each include a plurality of latches as at respectively latch 232, 234, 236 and 238. The metallic shield also includes a rear wall 240 which has apertures as at aperture 242 that engage latching projections as at projection 244 on the side walls. The side walls 228 and 230 each include a plurality of grounding projections as, for example, grounding projections 246 and 248 respectively. The metallic shield 222 also includes a front side 250 which has a plurality of plug receiving openings as at openings 252, 254, 256 and 258. These plug receiving openings are arranged so that pairs of them as, for example, 256 and 258 are in general vertical alignment except that the upper plug as at plug 256 is vertically displaced by a distanced on the lower plug as at 258. This distance d is preferably between 0.020" to 0.060". It is found that such a lateral displacement produces cross talk. This feature of the gang jack is further described in U.S. application Ser. No. 60/076,844 (EL-8057 P) filed Mar. 5, 1998 and U.S. application Ser. No. 09/143,810 (8057), filed Aug. 31, 1998, the contents of both of which are incorporated herein by reference.

Figure 17:
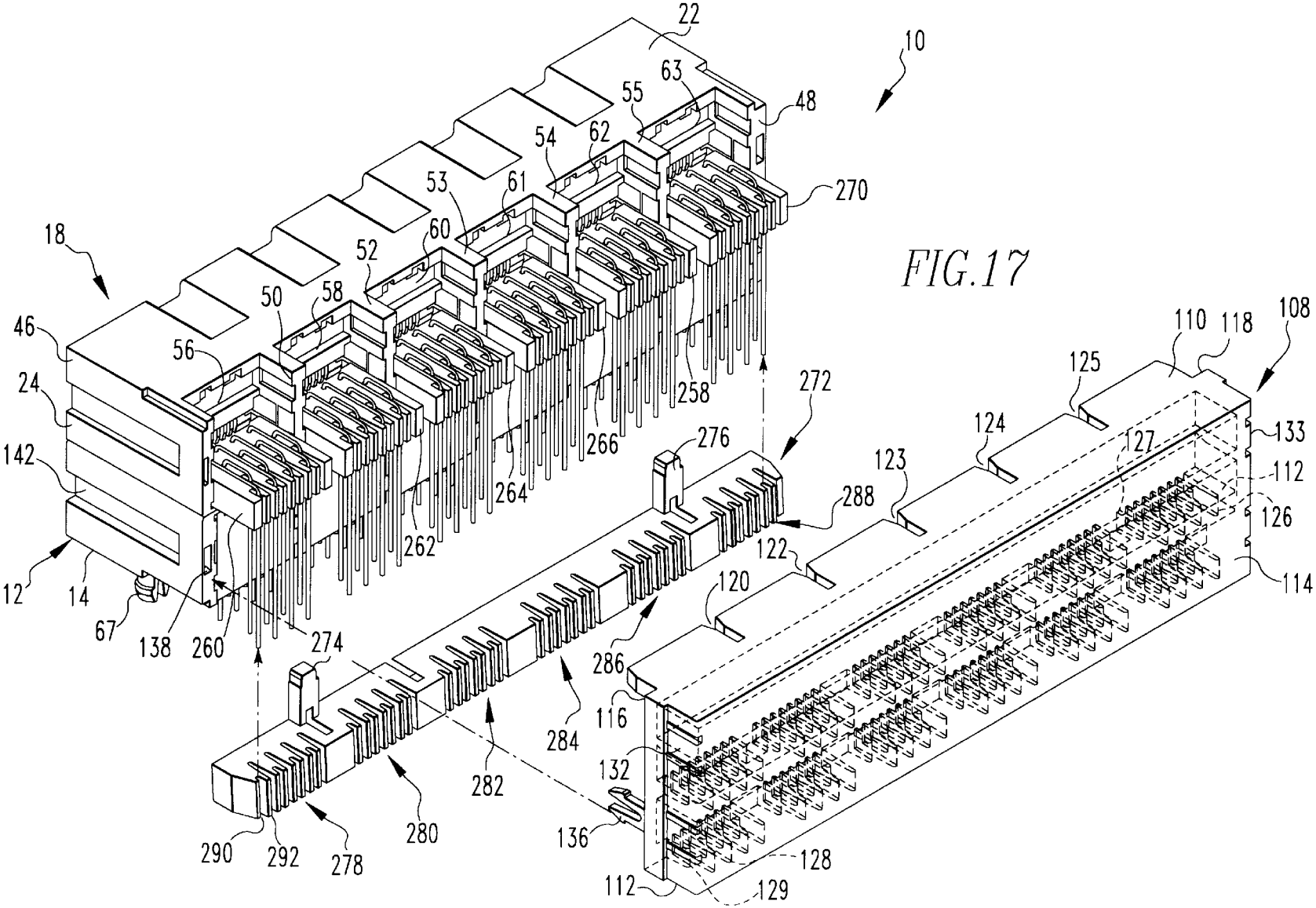
FIG. 17 is a perspective view of the modular gang jack in the present invention similar to FIG. 1 in which the use of an additional optional alignment bar is illustrated.

Referring to FIG. 17, the use of the gang jack with an additional aligning feature is shown. For the purposes of illustrating this feature, only the lower insert 260, 262, 264, 266, 268 and 270 are shown. It will be appreciated that the upper inserts as described above will also ordinarily be employed in the assembled gang jack. To align the wires in these lower inserts there may advantageously be employed an alignment bar 272. This alignment bar 272 has vertical projections 274 and 276. Beneath each of the lower inserts there is a group of eight v-shaped grooves 278, 280, 282, 284, 286 and 288. Each of these groups of grooves is made up of alternating shallow v-shaped grooves as at 290 and deep v-shaped grooves as at 292. The alignment bar 272 is employed by elevating it in the direction of the arrows shown in FIG. 17 to a position so that the vertical projection 274 is between inserts 260 and 262 and adjacent wall 50 and the vertical projection 276 is between inserts 268 and 270 adjacent wall 55. In this position each of the downwardly extending wires in insert 260 will be engaged by cone of the v-shaped grooves with the rear row of wires being engaged by the shallow v-shaped grooves as at groove 280 and the forward row of wires being engaged by the deep v-shaped grooves as at groove 292. The downwardly extending wires in inserts 262, 264, 266, 268 and 270 will be similarity engaged by the v-shaped grooves in group 280, 282, 284, 286 and 288 respectively.

It will be appreciated that there has been described a double deck modular gang jack which may be efficiently and inexpensively assembled from existing single deck gang jacks. The user may, therefore, be able to restrict his stock to only single deck gang jacks so that it will be possible to fulfill various needs with customized products in an economical manner.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular jack assembly comprising:

(a) an insulative housing comprising: (i) an integral first element having front and rear sides and comprising of a first and a second longitudinal wall positioned in spaced parallel relation and a first plurality of pairs of spaced, parallel lateral walls interposed between said first and second transverse walls to form a forward first plurality of plug receiving ports, all arranged in side by side relation, and (ii) an integral second element having front and rear sides and comprising a third and fourth longitudinal wall and a second plurality of pairs of spaced, parallel walls interposed between said third and further longitudinal walls to form a forward second plurality of plug receiving ports, all arranged in side by side relation, wherein a releasable latching means fixes the third longitudinal means of the second element in superimposed abutting relation on the second longitudinal wall of the first element;

(b) a first plurality of insulative inserts each having base and upper sides and rear end terminal ends and being positioned such that its terminal end extends into one of the first insert receiving ports; and (c) a second plurality of insulative inserts each having base and upper sides and rear and terminal ends and being positioned so that its terminal end extends into one of the second insert receiving ports.

2. The modular jack assembly of claim 1 wherein a cover is superimposed over the rear side of the first element and the second element.

3. The modular jack assembly of claim 1 wherein the cover is fixed to at least one of the elements by releasable clamping means.

4. The modular jack assembly of claim 3 wherein the cover is fixed to the first and second elements by releaseable clamping means.

5. The modular jack assembly of claim 1 wherein conductive means extend vertically from the base side to the upper side of each of the insulative inserts and then generally horizontally to the terminal end of the insulative insert and then downwardly and rearwardly toward the rear end of the insulative insert.

6. The modular jack assembly of claim 1 wherein the conductive means extends downwardly below the base side of the insulative insert.

7. The modular jack assembly of claim 2 wherein there are a plurality of generally parallel conductive means which extend vertically from the base side to the upper side of the insulative insert and then generally horizontally to the terminal end of the insulative insert and then downwardly and rearwardly toward the rear end of the insulative housing.

8. The modular jack assembly of claim 1 wherein each of the first plug receiving ports is longitudinally displaced from one of the second plug receiving ports by about 0.020" or more.

9. The modular jack assembly of claim 1 wherein the first plug receiving port is longitudinally displaced from the second plug receiving port.

10. The modular jack assembly of claim 1 wherein the first plug receiving port is longitudinally displaced from the second plug receiving port by about 0.020" or more.

11. The modular jack assembly of claim 2 wherein the first plug receiving port is longitudinally displaced from the second plug receiving port by about 0.020" to about 0.060".

12. An insulative housing comprising (i) an integral first element having front and rear sides and comprised of a first and a second longitudinal wall positioned in spaced parallel relation and a forward first plurality of pairs of lateral walls interposed between said first and second longitudinal walls to form a forward first plurality of plug receiving ports, all arranged in side by side relation, and (ii) an integral second element having front and rear sides and comprising a third and fourth longitudinal wall and a second plurality of pairs of spaced, parallel lateral walls interposed between said third and further longitudinal walls for form a forward second plurality of plug receiving ports, all arranged in side by side relation, wherein a releasable latching means fixes the third longitudinal means of the second element in superimposed abutting relation on the second longitudinal wall of the first element.

13. A method of manufacturing an insulative housing for an assembly comprising the steps of:

(a) providing a first element having front and rear sides and comprised of a first and a second longitudinal wall positioned in spaced parallel relation and a first plurality of pairs of lateral walls interposed between said first and second longitudinal walls to form a first plurality of plug receiving ports, all arranged in side by side relation;

(b) providing a second element having front end rear sides and comprising a third and fourth longitudinal wall and a second plurality of pairs of spaced, parallel lateral walls interposed between said third and further longitudinal walls to form a plurality of forward second plug receiving ports, all arranged in side by side relation;

(c) fixing the third longitudinal means of the second element in superimposed abutting relation on the second longitudinal wall of the first element by releasable latching means.

* * * * *